US010418723B1

(12) United States Patent
Livadaru et al.

(10) Patent No.: US 10,418,723 B1
(45) Date of Patent: Sep. 17, 2019

(54) DUAL POLARIZED CIRCULAR OR CYLINDRICAL ANTENNA ARRAY

(71) Applicant: Rockwell Collins, Inc., Cedar Rapids, IA (US)

(72) Inventors: Matilda G. Livadaru, Marion, IA (US); Jonathan A. Lovseth, Marion, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 0 days.

(21) Appl. No.: 15/832,683

(22) Filed: Dec. 5, 2017

(51) Int. Cl.

| | |
|---|---|
| ***H01Q 21/06*** | (2006.01) |
| ***H01Q 1/38*** | (2006.01) |
| ***H01Q 21/24*** | (2006.01) |
| ***H01Q 15/24*** | (2006.01) |

(52) U.S. Cl.
CPC ..... *H01Q 21/064* (2013.01); *H01Q 1/38* (2013.01); *H01Q 15/242* (2013.01); *H01Q 21/24* (2013.01)

(58) Field of Classification Search
CPC ..... H01Q 21/064; H01Q 1/38; H01Q 15/242; H01Q 21/24
USPC ..... 343/770
See application file for complete search history.

(56) References Cited

U.S. PATENT DOCUMENTS

| | | | | |
|---|---|---|---|---|
| 4,588,875 | A | 5/1986 | Kozak et al. | |
| 7,706,671 | B2 | 4/2010 | Brown | |
| 7,798,053 | B2 | 9/2010 | Clark et al. | |
| 8,126,320 | B2 | 2/2012 | Cartwright | |
| 8,736,504 | B1 | 5/2014 | West et al. | |
| 9,455,500 | B1 | 9/2016 | West et al. | |
| 9,516,968 | B2 | 12/2016 | Hill | |
| 9,647,748 | B1 | 5/2017 | Mitchell | |
| 9,716,309 | B1 | 7/2017 | Elsallal | |
| 9,825,373 | B1 * | 11/2017 | Smith | H01Q 21/24 |
| 10,109,928 | B2 * | 10/2018 | You | H01Q 1/521 |
| 2005/0131553 | A1 | 6/2005 | Yoon et al. | |
| 2011/0008029 | A1 | 1/2011 | Von Seidel | |
| 2014/0125542 | A1 * | 5/2014 | Honzawa | H01Q 13/0258 343/840 |

FOREIGN PATENT DOCUMENTS

| | | |
|---|---|---|
| CN | 201445353 | 5/2010 |
| CN | 202078138 | 12/2011 |
| EP | 2 116 158 | 11/2009 |
| GB | 2 283 664 | 5/1995 |
| GB | 2 413 477 | 11/2005 |
| GB | 2 475 324 | 5/2011 |
| JP | 4312412 | 11/1992 |
| WO | WO-03/085896 | 10/2003 |
| WO | WO-2007/131271 | 11/2007 |

* cited by examiner

*Primary Examiner* — Peguy Jean Pierre
(74) *Attorney, Agent, or Firm* — Donna P. Suchy

(57) ABSTRACT

An antenna array includes a first substrate having a first curved edge, a second substrate having a second curved edge, and members extending outwardly toward or past the first curved edge. The members include a first member and a second member below the first member. The antenna array also includes a vertical polarization (BAVA) element disposed perpendicular to the first substrate or the second substrate and between the first member and the second member, and a horizontal polarization BAVA element disposed parallel to the first substrate or the second substrate and between a top of the first member and the second member.

20 Claims, 5 Drawing Sheets

DUAL POLARIZED CIRCULAR OR CYLINDRICAL ANTENNA ARRAY

CROSS REFERENCE TO RELATED APPLICATION

The present application is related to U.S. patent application Ser. No. 15/413,052, filed Jan. 23, 2017 by West and assigned to the assignee of the present application, incorporated herein by reference in its entirety.

BACKGROUND

Embodiments of inventive concepts disclosed herein relate generally to antenna arrays and more particularly to a circular or cylindrical antenna arrays including but not limited to curved, circular or cylindrical Balanced Antipodal Vivaldi Antenna (BAVA) arrays.

Modern sensing and communication systems may utilize various types of antennas to provide a variety of functions, such as communication, radar, and sensing functions. For example, ultra-high frequency (UHF) and very high frequency (VHF) radio systems use directional and omnidirectional antenna arrays for data and voice communication. In another example, radar systems use antenna arrays to perform functions including but not limited to, sensing, intelligence-gathering (e.g., signals intelligence, or SIGINT), direction finding (DF), electronic countermeasure (ECM) or self-protection (ESP), electronic support (ES), electronic attack (EA) and the like. Providing multi-function capability from a single aperture for modern platforms is an important requirement. U.S. patent application Ser. No. 13/494,517, incorporated herein by reference in its entirety and discloses a vertically polarized array.

SUMMARY

In one aspect, embodiments of the inventive concepts disclosed herein are directed to an antenna array. The antenna array includes a first substrate having a first curved surface and members extending outwardly from the first curved surface. The members include a first member, second member below the first member, and third member laterally displaced from the first member and the second member. The antenna array also includes a vertical polarization (BAVA) element disposed perpendicular to a horizontal polarization BAVA element. The vertical polarization BAVA element is disposed between the first member and the second member, and the horizontal polarization BAVA element is disposed between one of the first or the second member and the third member.

In a further aspect, embodiments of the inventive concepts disclosed herein are directed to an antenna array. The antenna array includes a substrate having a curved surface, members extending outwardly from the curved surface, a vertical polarization (BAVA) element, and a horizontal polarization BAVA element. The members include a first member, a second member, and a third member. The first member is separated by a distance along a first axis from the second member, and the third member is separated by a distance along a second axis orthogonal to the first axis from at least one of the second member and the first member. The vertical polarization (BAVA) element is disposed between the first member and the second member, and a horizontal polarization BAVA element disposed perpendicular to the vertical polarization BAVA element and between the third member and one of the first member and the second member.

In a further aspect, embodiments of the inventive concepts disclosed herein are directed to an antenna system. The antenna system includes a housing structure having grounded members with slanted sides defining vertical and horizontal slots, a horizontal polarization printed circuit board element disposed in one of the horizontal slots, and a vertical polarization printed circuit board element disposed in one of the vertical slots. The horizontal polarization printed circuit board element is spaced at least a wavelength associated with a design parameter of the antenna system from a first side of the vertical slot and a second side of the vertical slot.

In a further aspect, embodiments of the inventive concepts disclosed herein are directed to an antenna system. The antenna system includes a housing substrate comprising a ring and members extending outwardly from the ring. The members include a first member and a second member, and the first member is above the second member. The antenna system also includes a horizontal polarization Balanced Antipodal Vivaldi Antenna (BAVA) element and a vertical polarization (BAVA) element. The horizontal polarization BAVA element is disposed parallel to a circumferential plane of the ring and the vertical polarization BAVA element is disposed perpendicular to the circumferential plane. The vertical polarization BAVA element includes a circuit board or a metal member disposed in plastic, and the vertical polarization BAVA element is disposed between the first member and the second member.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or maybe represented schematically in the interest of clarity. Like reference numerals in the drawings may represent and refer to the same or similar element, feature, or function. In the drawings.

DETAILED DESCRIPTION

Figure 1:
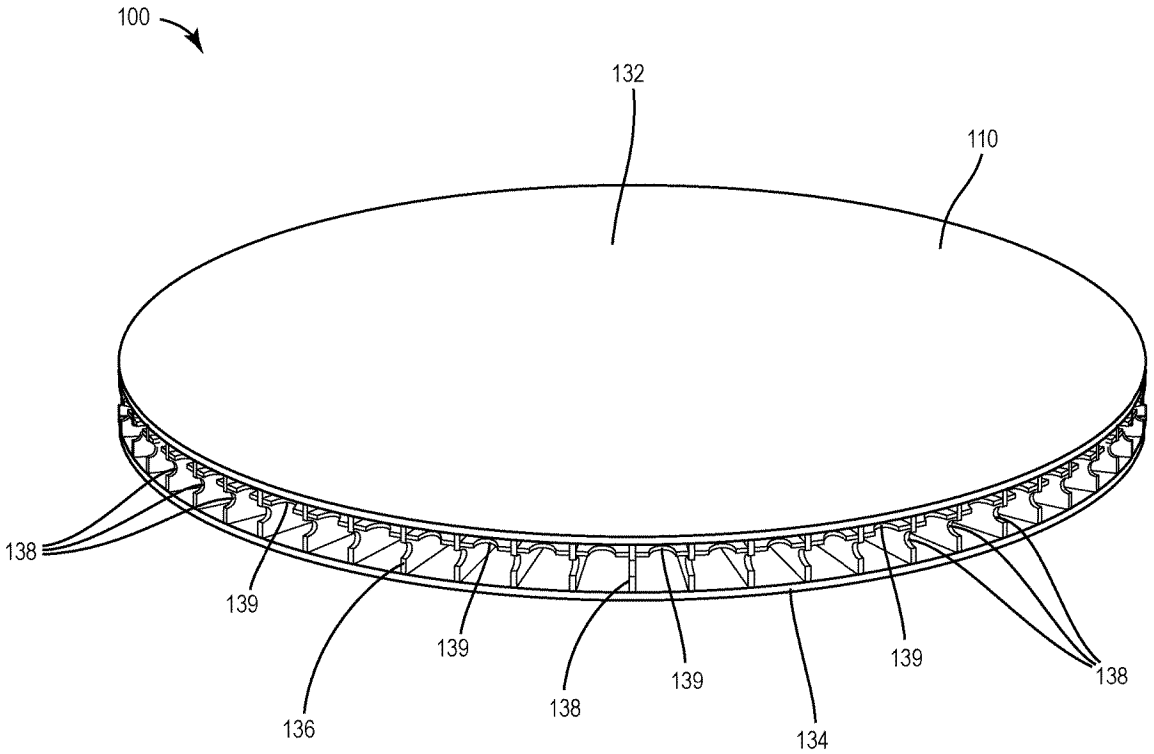
FIG. 1 is a perspective view of an antenna system according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits disclosed herein, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Some embodiments of the inventive concepts disclosed herein are directed to a radar, sensing, communication, discovery and/or networking system that utilizes an antenna system including circular, cylindrical, or elliptical array of antenna elements (e.g., Balanced Antipodal Vivaldi Antenna (BAVA) elements) to support very broad bandwidth operations. The antenna system is utilized as a common shared asset aperture, providing multifunctional, multi-beam support to facilitate multiband communications or operations in some embodiments.

In some embodiments, a dual polarization, ultra-wide band (UWB) circular or cylindrical array is provided for communications in a naval environment. The polarization includes but is not limited to: dual orthogonal linear (DOLP) polarization (e.g., horizontal and vertical polarization). In some embodiments, the array provides omnidirectional and directional modes in azimuth and provides shaped beams in elevation.

In some embodiments, the dual polarization array is comprised of vertical and horizontal polarization elements disposed in a lattice structure between two substrates. The vertical and horizontal polarization elements can be printed circuit board elements or metal elements disposed in plastic (e.g., for higher frequency). The polarization elements are radiating BAVA elements in some embodiments. It is to be understood that the terms horizontal and vertical are used herein to designate two elements or features that are oriented substantially orthogonally to one another, and do not necessarily denote any particular orientation of the various elements in reference to an external coordinate system or direction.

Referring to FIG. 1, an antenna system 100 for a communication system includes an antenna array 110 (e.g., a disc-shaped MCA). In some embodiments, the antenna system 100 is for a sensing radar system or electronic warfare radar system in some embodiments. The antenna array 110 is mounted on a conductive metallic surface of an air, maritime, or ground vehicle, a mount structure, a mast, a tower, or a pole in some embodiments. In some embodiments, the antenna array 110 is mounted on a mast of a ship for directional UHF communication operations or other operations discussed herein.

The antenna array 110 includes a substrate or medium 132 and a substrate or medium 134 positioned generally parallel with respect to each other, thereby forming a housing structure for vertical polarization elements 138 and horizontal polarization elements 139. The outer diameter of medium 134 coincides with the outer diameter of the medium 132 in some embodiments. Mediums 132 and 134 are optional or can be a plastic or other light weight protective housing in some embodiments.

In some embodiments, the medium 132 is a ring-shaped conductive member, and the medium 134 is a disc-shaped conductive medium. An area 136 is disposed between the medium 134 and the medium 132. The area 136 includes regions for the horizontal and vertical polarization elements 139 and 138 (e.g., respectively parallel to and perpendicular to the mediums 132 and 134) in some embodiments. Exemplary radiating or antenna elements associated with the regions are also discussed in more detail with reference to FIGS. 2-5. In some embodiments, additional antenna arrays (e.g., similar to the antenna array 110) are stacked on top of the antenna array 110.

Figure 2:
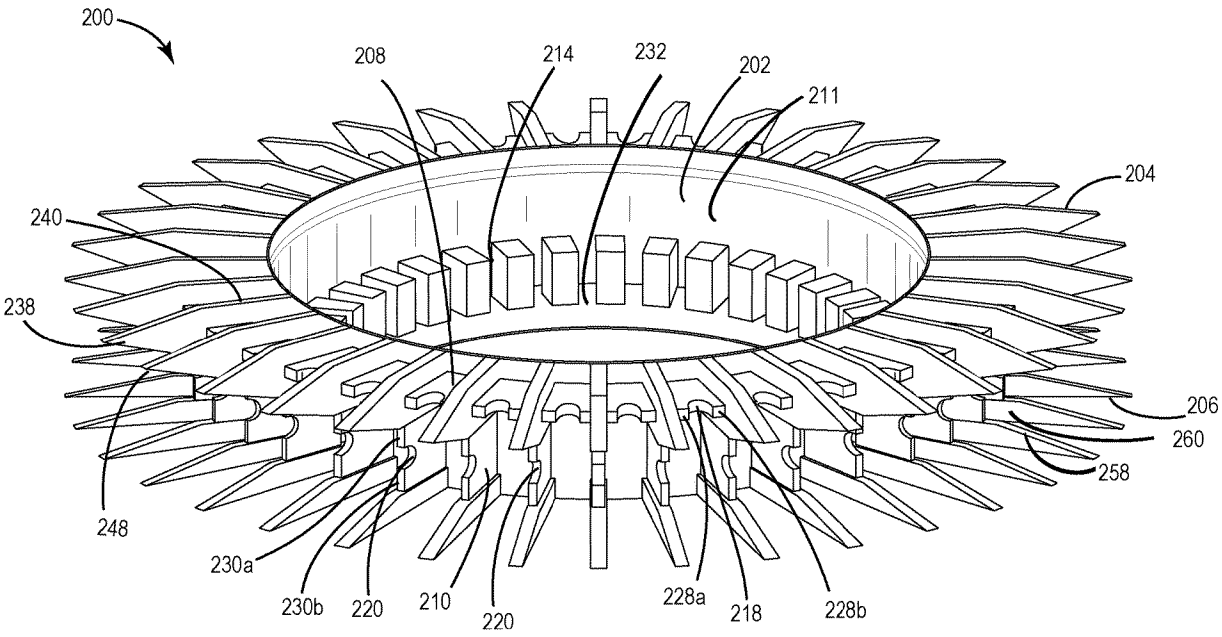
FIG. 2 is a schematic perspective view of an assembly for an antenna system according to exemplary aspects of the inventive concepts disclosed herein.

With reference to FIG. 2, a lattice or an assembly 200 for an antenna array, such as the antenna array 110 (FIG. 1) is shown. The assembly 200 can be provided as a stand-alone structure, can be provided as an interior of the antenna system 100 (FIG. 1), or can be covered in a housing. In some embodiments, the assembly 200 includes a substrate including an inner ring 202, an upper set of lattice members 204, and a lower set of lattice members 206. The assembly 200 also includes a set of horizontal polarization elements 208 and a set of vertical polarization elements 210. The assembly 200 includes a set of electronics and connectors 214 corresponding to the set of horizontal polarization elements 208 and vertical polarization elements 210 in some embodiments.

The assembly 200 is disposed between mediums 132 and 134 (FIG. 1) in some embodiments. In some embodiments, the mediums 132 and 134 are not utilized. The diameter of the assembly 200 is 16 meters in some embodiments. The inner ring 202 and the lattice members 204 and 206 can include holes to reduce weight. The inner ring 202 includes a curved surface 211 to which the lattice members 204 and 206 are attached. The inner ring 202 can be mounted to a mast of a ship for communication operations.

The lattice members 204 and 206 define slots or receptacles for receiving the horizontal polarization elements 208 and the vertical polarization elements 210. The horizontal polarization elements 208 are disposed between a pair of upper members 204 and are parallel to the mediums 132 and 134 (parallel to a circumferential plane of the ring 202) in some embodiments. In some embodiments, the horizontal polarization elements 208 are disposed between a pair of immediately adjacent upper members 204. The vertical polarization elements 210 are disposed between a pair of one of the upper members 204 and one of the lower members 206 directly beneath the one of the upper members 204 in some embodiments. The vertical polarization elements 210 are perpendicular to the mediums 132 and 134 (FIG. 1) (and to the horizontal polarization elements 208) in some embodiments. The vertical polarization elements 210 and the horizontal polarization elements 208 are disposed at positions in the assembly 200 to avoid short-circuiting current in some embodiments. The horizontal and vertical polarization elements 139 and 138 (FIG. 1) are similar to the horizontal polarization elements 208 and the vertical polarization elements 210 in some embodiments.

In some embodiments, the horizontal and vertical polarization elements 208 and 210 are BAVA elements. In some embodiments, the horizontal and vertical polarization elements 208 and 210 are circuit board based elements or metal structures in an insulated frame (e.g., embedded in plastic). The circuit boards for the horizontal and vertical polarization elements 208 and 210 are 20 inch by 20 inch printed circuit boards (e.g., single layer or multiple layers) including an insulating medium (e.g., FR4 glass epoxy, ceramics, FR5 glass epoxy, polyimide, Teflon, etc.) and conductive (e.g., copper) traces in some embodiments. In some embodiments, the horizontal polarization elements 208 include a slot 218 and the vertical polarization elements 210 include a slot 220. The horizontal polarization elements 208 include fingers 228*a* and 228*b* separated by the slot 218. The vertical polarization elements 210 include fingers 230*a* and 230*b* separated by the slot 220.

In some embodiments, the horizontal and vertical polarization elements 208 and 210 are arranged to form a circular antenna array along the curved edges of the mediums 132 and 134 (FIG. 1) or extending from the ring 202. The mediums 132 and 134 (FIG. 1) jointly form a parallel plate waveguide for the circular antenna array or a cylindrical array in some embodiments. In some embodiments, the electronics and connectors 214 are connected directly to each of the horizontal and vertical polarization elements 208 and 210 and are disposed at a bottom flange 232 of the ring 202. The electronics and connectors 214 include beam former circuitry that is analog in nature with amplitude and time delay (or phase shift) adjustment circuitry in some embodiments. In some embodiments, the beam former circuitry can utilize digital beam forming (DBF) circuits where either direct digital I/Q sampling (e.g., pure DBF) RF down conversion occurs immediately behind each radiating element (hybrid DBF) and radiation beams are formed through DBF techniques. In some embodiments, the beam former circuitry includes arrays of phase shifters and variable gain amplifiers for effecting DBF.

Parameters associated with the antenna system 100 and the assembly 200 can vary based on the operating frequencies supported by the antenna system 100 or the assembly 200. In some embodiments, the outer diameters of the system 100 and assembly 200 is configured to be approximately 5 to 20 meters (e.g., 16 meters). In some embodiments, the assembly 200 includes approximately 5 inch by 5 inch to 40 inch by 40 inch (e.g., 20 inch by 20 inch) horizontal and vertical polarization elements 208 and 210 evenly disposed along the circumference of the assembly 200. The horizontal and vertical polarization elements 208 and 210 can have the BAVA element structure described in U.S. patent application Ser. No. 13/494,517 incorporated herein by reference in its entirety. Coincident phase center BAVA elements are discussed in U.S. Pat. Nos. 8,736,504 and 9,455,500, incorporated herein by reference in their entireties. The specific values of the array parameters described above are exemplary.

The lattice members 204 are conductive grounded material in some embodiments. The members 204 include a triangular portion 238 (e.g., isosceles triangle) extending outwardly from a center of the ring 202 and a rectangular portion 240 in contact with the ring 202. The members 206 are conductive grounded material in some embodiments. The lattice members 206 include a triangular portion 258 (e.g., right triangle) extending outwardly from a center of the ring 202 and a rectangular portion 260 in contact with the ring 202. The lattice members 206 and 204 extend outwardly toward or past the curved, circumferential edge associated with the mediums 132 and 134 (FIG. 1) in some embodiments. The medium 132 is attached to the upper members 204, and the medium 134 is attached to the lower members 206 in some embodiments. The horizontal polarization elements 208 are disposed in the plane parallel to the circumference of the ring 202 and including a point 248 associated with the triangular portion 238.

Figure 3:
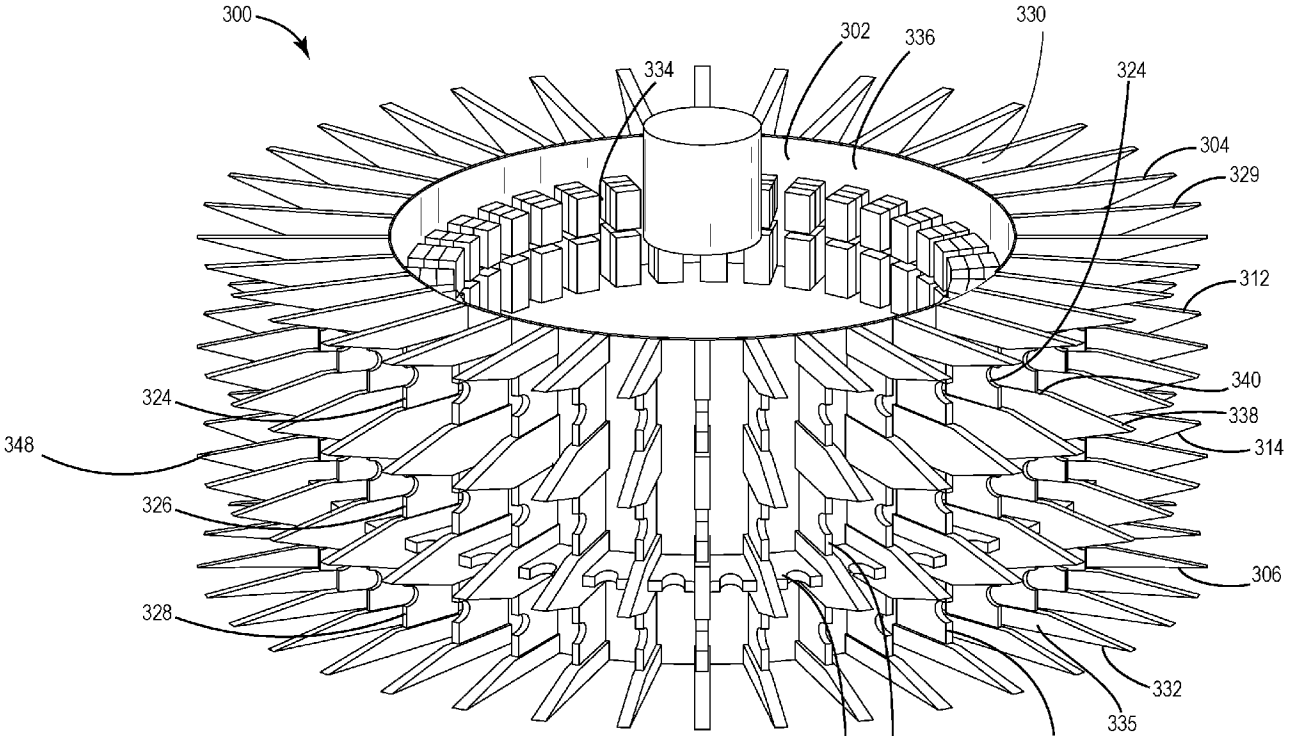
FIG. 3 is a schematic perspective view for an another assembly for an antenna system according to exemplary aspects of the inventive concepts disclosed herein.

With reference to FIG. 3, a lattice or an assembly 300 for an antenna system, such as the antenna system 100 (FIG. 1), includes an inner ring 302, an upper set of lattice members 304, a lower set of lattice members 306, an upper middle set of lattice members 312, a lower middle set of lattice members 314, a set of horizontal polarization elements 322, a set of vertical polarization elements 324, a set of vertical polarization elements 326, and a set of vertical polarization elements 328. The assembly 300 is similar to the assembly 200 and is a stand-alone structure or is provided between the mediums 132 and 134 (FIG. 1) in some embodiments.

The assembly 300 includes a set of electronics and connectors 334 corresponding to the set of horizontal polarization elements 322 and the vertical polarization elements 324, 326, and 328 in some embodiments. In some embodiments, the set of electronics and connectors 334 are provided in two or more layers on the ring 302 and are similar to the set electronics and connectors 214 (FIG. 2) and are disposed on an inner surface 336 of the ring 302.

The lattice members 304 are conductive grounded material in some embodiments. The members 304 include a triangular portion 329 (e.g., right triangle) extending outwardly from a center of the ring 302 and a rectangular portion 330 in contact with the ring 302. The lattice members 306 are conductive grounded material in some embodiments. The members 306 include a triangular portion 332 (e.g., right triangle) extending outwardly from a center of the ring 302 and a rectangular portion 335 in contact with the ring 302. The lattice members 312 and 314 are conductive grounded material in some embodiments. The members 312 and 314 include a triangular portion 338 (e.g., isosceles triangle) extending outwardly from a center of the ring 302 and a rectangular portion 340 in contact with the ring 302.

The vertical polarization elements 324 are disposed between respective lattice members 304 and 312. The vertical polarization elements 326 are disposed between respective lattice members 314 and 312. The vertical polarization elements 328 are disposed between respective lattice members 314 and 306. The horizontal polarization elements 322 are disposed between neighboring lattice members 314. The horizontal polarization elements 322 are disposed in the plane parallel to a circumference of the ring 302 and containing a point 348 associated with the triangular portion 338. The horizontal polarization elements 322, the vertical polarization elements 324, the vertical polarization elements 326, and the vertical polarization elements 328 are similar to the horizontal and vertical polarization elements 208 and 210 in some embodiments.

Figure 4:
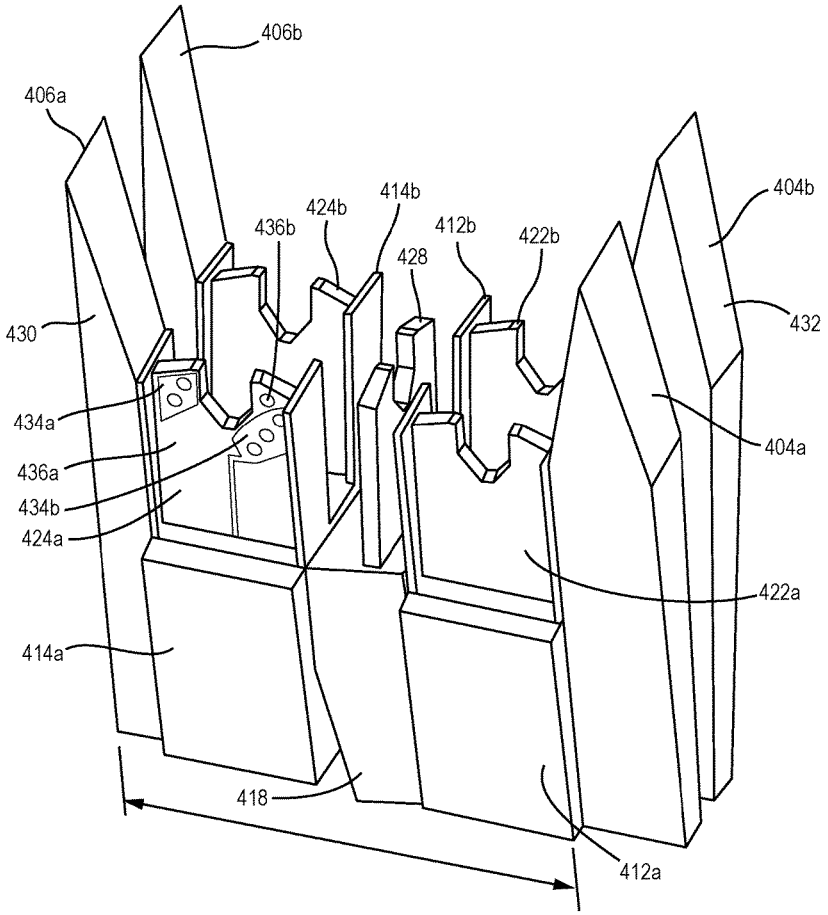
FIG. 4 is a schematic perspective view of showing a chassis and BAVA elements for another assembly for an antenna system according to exemplary aspects of the inventive concepts disclosed herein.

With reference to FIG. 4, a chassis or an arrangement 400 can be used in a lattice or an assembly similar to assemblies 200 and 300 or can be used in an interior of antenna array 110 (FIG. 1). The arrangement 400 includes an upper set of lattice members 404*a* and *b*, a lower set of lattice members 406*a* and *b*, a pair of upper receptacles 412*a* and *b*, a pair of lower receptacles 414*a* and *b*, a middle receptacle 418, a pair of vertical polarization elements 422*a* and *b*, a pair of vertical polarization elements 424*a* and *b*, and a horizontal polarization element 428. The pair of upper receptacles 412*a* and *b* house respective vertical polarization elements 422*a* and *b*. The pair of lower receptacles 414*a* and *b* house respective vertical polarization elements 424*a* and *b*. The middle receptacle 418 houses the horizontal polarization element 428.

The horizontal polarization element 428 is spaced a distance of at least one wavelength from the lattice members 406*a-b* and 404*a-b* to prevent short circuiting in some embodiments (e.g., at higher frequencies). The wavelength is associated with the lowest frequency signal for which the antenna array (e.g., the antenna array 110 (FIG. 1)) is designed to receive in some embodiments. In some embodiments, the horizontal polarization element 428 is placed so that the lattice members 404*a* and *b* and the lattice members 406*a* and *b* do not short the horizontal polarization element 428.

The receptacles 412*a-b*, 414*a-b*, and 418 and lattice members 406*a-b* and 404*a-b* are grounded metal structures in some embodiments. The lattice members 406*a-b* are similar to the lattice members 206 (FIG. 2), and the lattice members 404*a-b* are similar to the lattice members 204 (FIG. 2) in some embodiments. The lattice members 406*a-b* and 404*a-b* extend outwardly beyond the receptacles 412*a-b*, 414*a-b*, and 418, the vertical polarization elements 422*a-b* 424*a-b*, and the horizontal polarization element 428 in some embodiments. Right triangle sections 430 of lattice members 406*a-b* begin and extend outwardly from the most outward position of the vertical polarization members 424*a-b* and receptacles 414*a-b*. Isosceles triangle sections 432 of lattice members 404*a-b* begin and extend outwardly from the most outward position of the vertical polarization members 422*a-b* and receptacles 412*a-b*.

The vertical polarization elements 424*a-b* include radiating elements 434*a-b* disposed on fingers 436*a-b*. The radiating elements 434*a-b* are printed circuit board conductive areas in some embodiments. Radiating elements similar to the radiating elements 434*a-b* are provided on the opposite side of the vertical polarization elements 424*a-b* in some embodiments. The horizontal polarization element 428 and the vertical polarization members 424*a-b* include similar radiating elements disposed in a similar fashion in some embodiments. The radiating elements 434*a-b* can be metal material embedded in plastic in some embodiments. The horizontal polarization element 428 and the vertical polarization members 422*a-b* and 424*a-b* extend to outwardly from the ring 202 or 302 (FIGS. 2 and 3) in some embodiments. The horizontal polarization elements 139, 208 and 322 and the vertical polarization elements 138, 210, 324, 326, and 328 (FIGS. 1-3) include radiating elements similar to the radiating elements 434*a-b* in some embodiments. In some embodiments, the horizontal polarization elements 139, 208, 322, and 428 and the vertical polarization elements 138, 210, 324, 326, 328, 422*a-b* and 424*a-b* (FIGS. 1-4) are stamped metal sheets.

Figure 5:
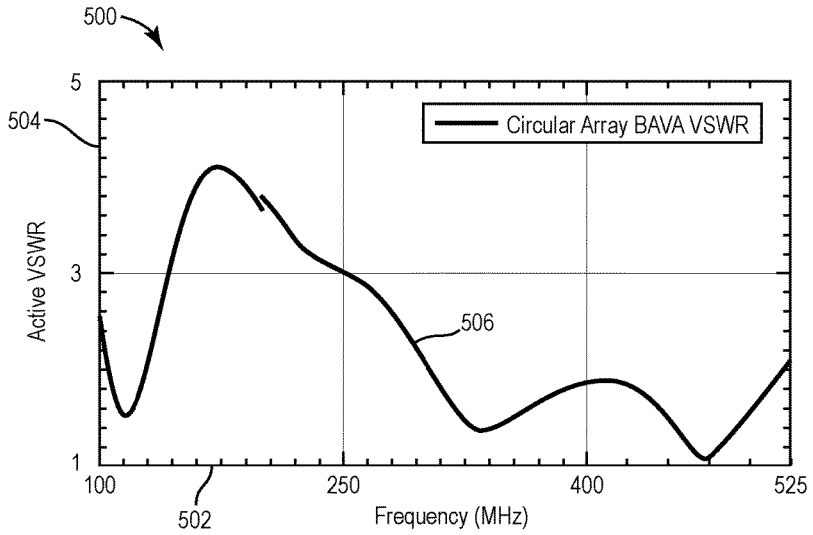
FIG. 5 is a graph showing a polarization element response for a BAVA circular array according to exemplary aspects of the inventive concepts disclosed herein.

With reference to FIG. 5, a graph 500 includes an X-axis 502 representing frequency and a Y-axis 504 representing active voltage standing wave ratio (VSWR) for a vertical polarization element and/or a horizontal polarization element in a circular array such as the antenna array 110 (FIG. 1). A line 506 represents the response of the vertical polarization element (e.g., elements 210, 324, 326, 328, 412*a-b*, or 414*a-b*) or the horizontal polarization element (e.g., elements 208, 328, and 428) across a frequency spectrum between 100 and 525 MHz. The line 506 shows improvement in the VSWR (e.g., in the 300 MH to 525 MHz range). The antenna array can be designed for other frequency ranges. In some embodiments, the operational bandwidth has a 5:1 ratio (e.g. high frequency/low frequency) or is in the VHF to the UHF range.

The antenna system 100, the assemblies 200 and 300 and/or the arrangement 400 can be constructed using a wire housing configuration for the mediums 132 and 134, lattice members 204, 206, 304, 306, 312, 314, 404*a-b*, and 406*a-b*, and the inner rings 202 and 302 in some embodiments. The wire housing configuration is grounded in some embodiments. Grounding ensures that the horizontal plane (H-plane) scan is not short circuited for both horizontal and vertical implementations in some embodiments. In some embodiments, the wire housing configuration resembles a chicken wire mesh and is used at frequencies of approximately 500 MHz where a solid ground is not necessary for the antenna system 100 or the assemblies 200 and 300.

The construction and arrangement of the systems and methods as shown in the various exemplary embodiments are illustrative only. For example, although specific shapes of mediums 132 and 134 and lattice members 204,206, 304, 306 312, 314, 404*a-b*, and 406*a-b* are discussed, other shapes can be utilized. The mediums 132 and 134 can be eliminated from the design in some embodiments. Further, other numbers of horizontal polarization elements and vertical polarization elements and ratios thereof can be used. Although only a number of embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed, flipped, or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna array, comprising:

a substrate having a curved surface;

a plurality of members extending outwardly from the curved surface, wherein the members include a first member, a second member, and a third member, the first member being separated by a distance along a first axis from the second member, the third member being separated by a distance along a second axis orthogonal to the first axis from at least one of the second member and the first member;

a vertical polarization (BAVA: Balanced Antipodal Vivaldi Antenna) element being disposed between the first member and the second member; and a horizontal polarization (BAVA) element disposed perpendicular to the vertical polarization (BAVA) element and between the third member and one of the first member and the second member.

2. The antenna array of claim 1, wherein a set of the members are grounded and provide a chassis comprising an additional vertical polarization (BAVA) element.

3. The antenna array of claim 2, wherein the chassis comprises an additional pair of the vertical polarization (BAVA) element and the horizontal polarization (BAVA) element without any additional polarization elements.

4. The antenna array of claim 2, wherein the chassis comprises an upper slot for one of a pair of vertical polarization (BAVA) elements, a lower slot for another of a pair of vertical polarization (BAVA) elements, and a middle slot for the horizontal polarization (BAVA) element.

5. The antenna array of claim 1, wherein the substrate is conductive and the curved surface is circular, wherein the first axis is parallel to a central axis of the curved surface.

6. The antenna array of claim 1, wherein the horizontal polarization (BAVA) element and vertical polarization (BAVA) element each comprise a pair of fingers extending outwardly from the curved surface, wherein the (BAVA) vertical polarization element is a flat card disposed in a plane containing the first axis and the (BAVA) horizontal polarization element is a flat card disposed in a plane containing the first axis.

7. The antenna array of claim 1, wherein the horizontal polarization (BAVA) element and vertical polarization (BAVA) element are printed circuit board cards comprising a printed radiator.

8. The antenna array of claim 1, wherein the horizontal polarization (BAVA) element and vertical polarization (BAVA) element comprise metal material embedded in plastic or a stamped metal sheet.

9. The antenna array of claim 1, wherein the horizontal polarization (BAVA) element and the vertical polarization (BAVA) element each comprise a pair of fingers extending from the curved surface and each of the pair of fingers comprises a printed antenna element.

10. An antenna system comprising:

a housing structure having a plurality of grounded members with slanted sides defining vertical slots and horizontal slots;

a horizontal polarization printed circuit board element disposed in one of the horizontal slots; and a vertical polarization printed circuit board element disposed in one of the vertical slots, wherein the horizontal polarization printed circuit board element is spaced at least a wavelength associated with a design parameter of the antenna system from a first side of the one of the vertical slots and a second side of the one of the vertical slots.

11. The antenna system of claim 10, wherein the horizontal polarization printed circuit board element and the vertical polarization printed circuit board element are disposed in a metal chassis, the metal chassis comprising three receptors, wherein a middle receptor houses the horizontal polarization printed circuit board element and at least one of a pair of end receptors houses the vertical polarization printed circuit board element.

12. The antenna system of claim 10, wherein the wavelength is based on a lowest operating frequency supported by a radar system for the antenna system.

13. The antenna system of claim 10, wherein the horizontal polarization printed circuit board element and the vertical polarization printed circuit board element are disposed in a metal chassis, the metal chassis comprising three receptors, wherein a middle receptor houses the horizontal polarization printed circuit board element and a pair of end receptors houses a pair of the vertical polarization printed circuit board element.

14. The antenna system of claim 10, wherein the grounded members comprise four corner members with a slanted top face.

15. The antenna system of claim 10, wherein the horizontal polarization printed circuit board element and the vertical polarization printed circuit board element are perpendicular to each other, wherein the horizontal polarization printed circuit board element and the vertical polarization printed circuit board element each comprise a pair of fingers extending outwardly towards the slanted sides and the pair of fingers comprises a printed antenna element.

16. An antenna system, comprising:

a housing substrate comprising a ring and a plurality of members extending outwardly from the ring, wherein the members include a first member and a second member, the first member being above the second member;

a horizontal polarization Balanced Antipodal Vivaldi Antenna (BAVA) element; and a vertical polarization (BAVA) element, wherein the horizontal polarization (BAVA) element is disposed parallel to a plane containing a circumference of the ring and the vertical polarization (BAVA) element is disposed perpendicular to the horizontal polarization (BAVA) element, wherein the vertical polarization (BAVA) element comprises a circuit board or a metal member disposed in plastic, the vertical polarization (BAVA) element being disposed between the first member and the second member.

17. The antenna system of claim 16, wherein the antenna system is a circular antenna array and further comprising:

two or more vertical polarization (BAVA) elements for each horizontal polarization (BAVA) element.

18. The antenna system of claim 16, wherein the housing substrate comprises a third member and a fourth member, the third member being to a right of the first member and above the fourth member, wherein the horizontal polarization (BAVA) element is between a line between the first member and the third member and a line between the second member and the fourth member.

19. The antenna system of claim 18, wherein the first member, the second member, the third member, and the fourth member each have a triangular portion extends outwardly past the horizontal polarization (BAVA) element.

20. The antenna system of claim 18, further comprising:

two or more vertical polarization (BAVA) elements for each horizontal polarization element, and each triangular portion extends outwardly past the horizontal polarization element.

* * * * *